US006047658A

United States Patent [19]

Tansy

[11] Patent Number: 6,047,658

[45] Date of Patent: Apr. 11, 2000

[54] BOAT PROTECTION AND STORAGE DEVICE

[76] Inventor: Larry J. Tansy, 5515 SW. 11th Pl., Cape Coral, Fla. 33914

[21] Appl. No.: 09/150,950

[22] Filed: Sep. 10, 1998

[51] Int. Cl.[7] ..... B63B 35/44

[52] U.S. Cl. ..... 114/263; 114/45; 114/222

[58] Field of Search ..... 114/44, 45, 46, 114/47, 61.1, 361, 222, 263

[56] References Cited

U.S. PATENT DOCUMENTS

| | | | |
|---|---|---|---|
| 1,300,954 | 4/1919 | Gray | 114/45 |
| 3,685,477 | 8/1972 | Wood | 114/222 |
| 4,280,439 | 7/1981 | Jackson | 1114/222 |
| 4,341,174 | 7/1982 | Stevens, Jr. et al. | 114/47 |
| 5,465,676 | 11/1995 | Falcaro | 114/222 |
| 5,549,069 | 8/1996 | Faidi | 114/222 |

*Primary Examiner*—Stephen Avila

[57] ABSTRACT

A boat protection and storage device including a housing dimensioned for receiving a boat therein. The housing is adapted for floating in a body of water. A gate member couples with an open rearward wall of the housing. A buoyant member is secured to the housing.

4 Claims, 3 Drawing Sheets

FIG 5
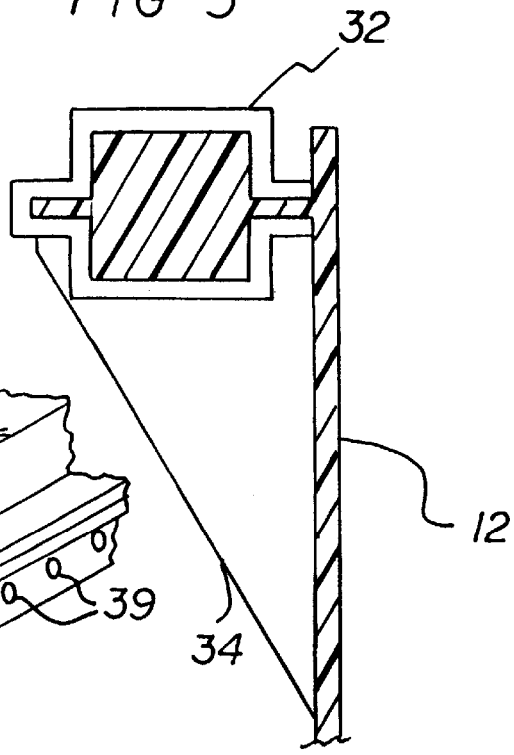
FIG 7
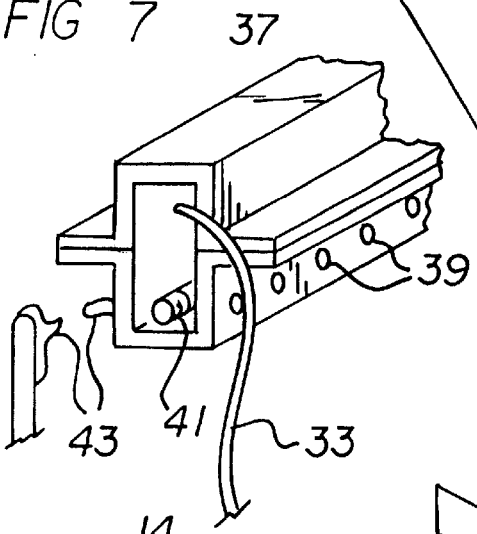
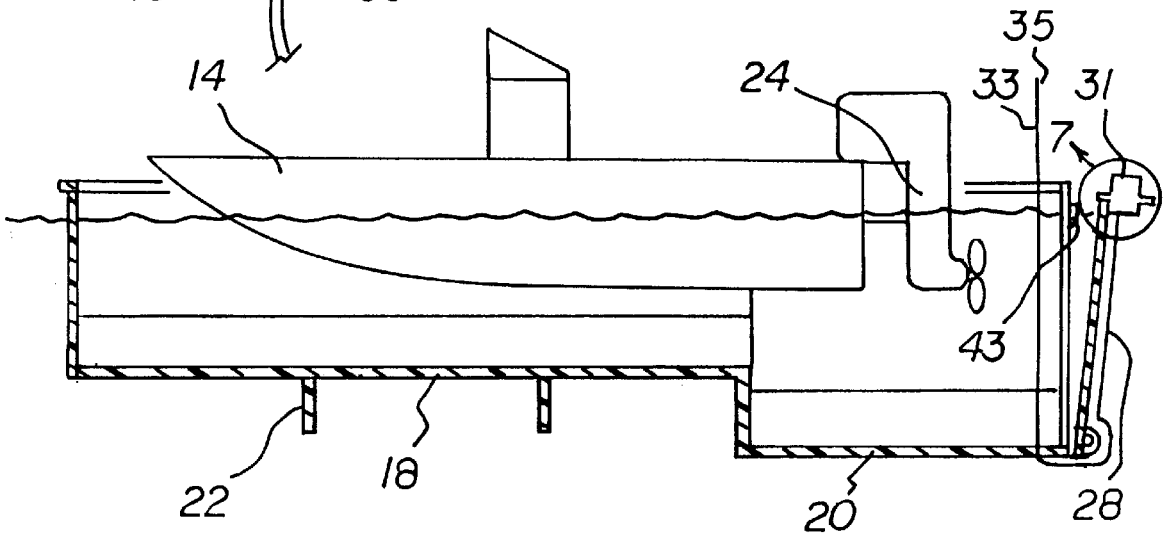
FIG 6

BOAT PROTECTION AND STORAGE DEVICE

BACKGROUND OF THE INVENTION

1. Field of the Invention

The present invention relates to a boat protection and storage device and more particularly pertains to preventing build-up of bacteria and barnacles and other corrosive materials on a hull of a boat with a boat protection and storage device.

2. Description of the Prior Art

The use of hull protection devices is known in the prior art. More specifically, hull protection devices heretofore devised and utilized for the purpose of protecting the hull of boats are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,280,439 to Jackson; U.S. Pat. No. 4,341,174 to Stevens, Jr. et al.; U.S. Pat. No. 4,763,592 to Russ; U.S. Pat. No. 3,205,851 to Wiswell, Jr.; U.S. Pat. No. 4,184,216 to Saleen; and U.S. Pat. No. 5,071,287 to Wallace.

While these devices fulfill their respective, particular objective and requirements, the aforementioned patents do not describe a boat protection and storage device for preventing build-up of bacteria and barnacles and other corrosive materials on a hull of a boat.

In this respect, the boat protection and storage device according to the present invention substantially departs from the conventional concepts and designs of the prior art, and in doing so provides an apparatus primarily developed for the purpose of preventing build-up of bacteria and barnacles and other corrosive materials on a hull of a boat.

Therefore, it can be appreciated that there exists a continuing need for new and improved boat protection and storage device which can be used for preventing build-up of bacteria and barnacles and other corrosive materials on a hull of a boat. In this regard, the present invention substantially fulfills this need.

SUMMARY OF THE INVENTION

In the view of the foregoing disadvantages inherent in the known types of hull protection devices now present in the prior art, the present invention provides an improved boat protection and storage device. As such, the general purpose of the present invention, which will be described subsequently in greater detail, is to provide a new and improved boat protection and storage device and method which has all the advantages of the prior art and none of the disadvantages.

To attain this, the present invention essentially comprises a housing dimensioned for receiving a boat therein. The housing is adapted for floating in a body of water. The housing has an open upper end, a closed lower end, a closed forward wall, an open rearward wall, and closed opposed side walls. The housing is constructed with reinforced vertically disposed ridges. The housing includes a forward section and a rearward section. The closed lower end of the forward section has a pair of support webs. The rearward section has a greater depth than the forward section for accommodating a motor of a boat positioned within the housing. Upper ends of the opposed side walls each have a lateral edge portion extending outwardly therefrom. A gate member couples with the open rearward wall of the housing. The gate member has a top edge, a bottom edge, and opposed side edges. The bottom edge is hingedly coupled with a lower edge of the open rearward wall. The top edge has a lateral edge portion extending outwardly therefrom. A buoyant member is secured to the housing. The buoyant member is secured to and extend along a length of an upper surface of the lateral edge portions of the opposed side walls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat protection and storage device which has all the advantages of the prior art hull protection devices and none of the disadvantages.

It is another object of the present invention to provide a new and improved boat protection and storage device which may be easily and efficiently manufactured and marketed.

It is a further object of the present invention to provide a new and improved boat protection and storage device which is of durable and reliable construction.

An even further object of the present invention is to provide a new and improved boat protection and storage device which is susceptible of a low cost of manufacture with regard to both materials and labor, and which accordingly is then susceptible of low prices of sale to the consuming public, thereby making such a boat protection and storage device economically available to the buying public.

Even still another object of the present invention is to provide a new and improved boat protection and storage device for preventing build-up of bacteria and barnacles and other corrosive materials on a hull of a boat.

Lastly, it is an object of the present invention to provide a new and improved boat protection and storage device including a housing dimensioned for receiving a boat therein. The housing is adapted for floating in a body of water. A gate member couples with an open rearward wall of the housing. A buoyant member is secured to the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the present invention as taken along line 5—5 of FIG. 1.

FIG. 6 is a cross-sectional view of the present invention as taken along line 6—6 of FIG. 2.

FIG. 7 is an enlarged perspective view taken at Circle 7 of FIG. 6.

The same reference numerals refer to the same parts through the various figures.

DESCRIPTION OF THE PREFERRED EMBODIMENT

Figure 1:
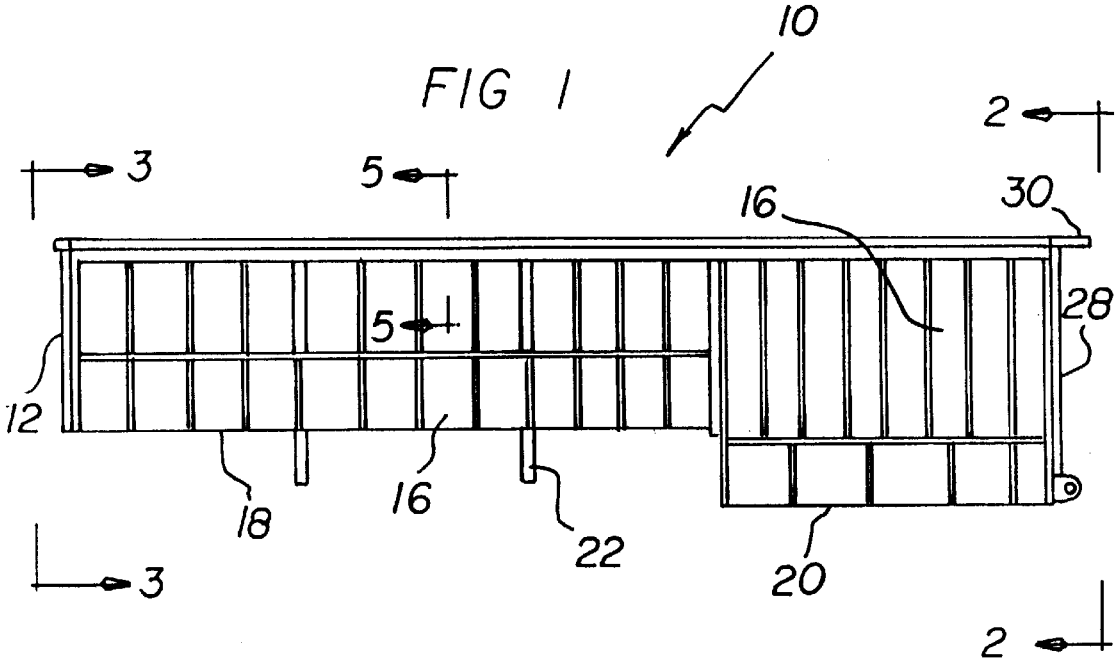
FIG. 1 is a side elevational view of the preferred embodiment of the boat protection and storage device constructed in accordance with the principles of the present invention.
Figure 2:
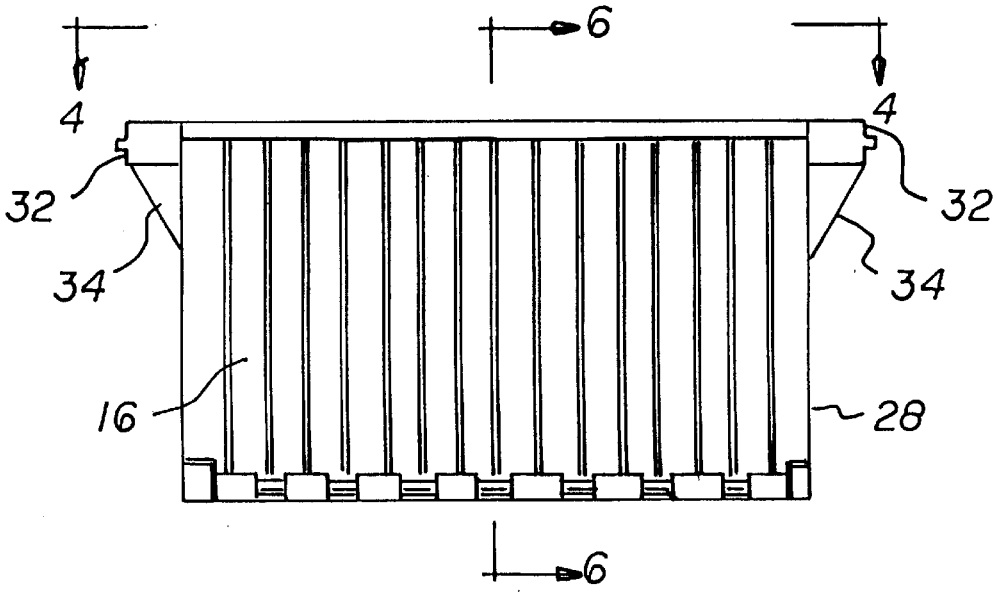
FIG. 2 is a rear elevational view of the present invention as taken along line 2—2 of FIG. 1.
Figure 3:
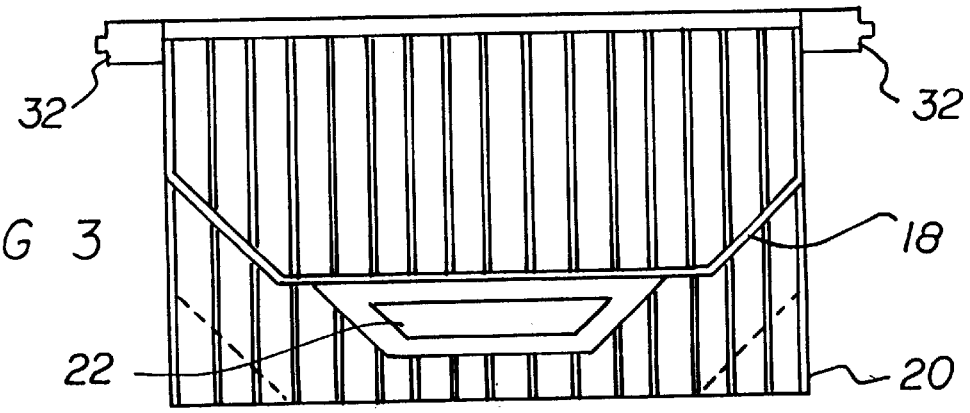
FIG. 3 is a front elevational view of the present invention as taken along line 3—3 of FIG. 1.
Figure 4:
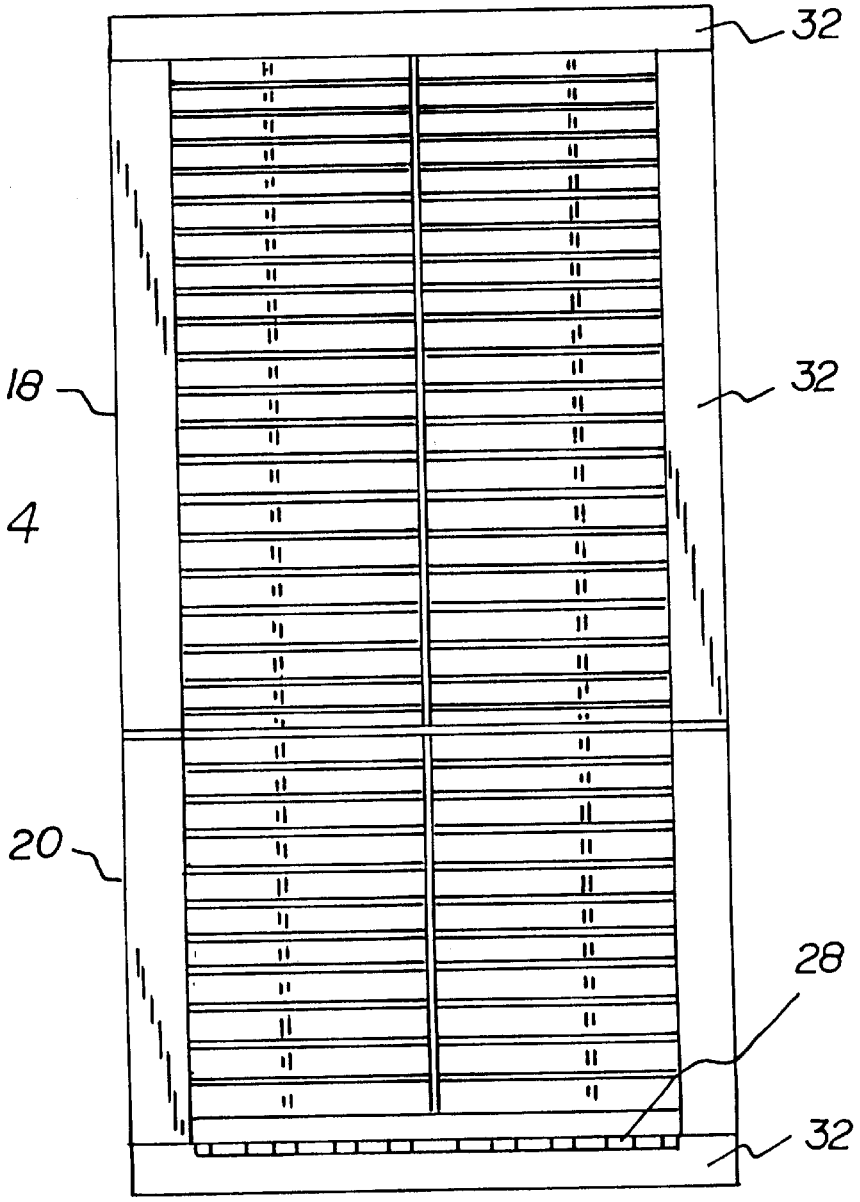
FIG. 4 is a top plan view of the present invention as taken along line 4—4 of FIG. 2.

With reference now to the drawings, and in particular, to FIGS. 1 through 6 thereof, the preferred embodiment of the new and improved boat protection and storage device embodying the principles and concepts of the present invention and generally designated by the reference number 10 will be described.

Specifically, it will be noted in the various Figures that the device relates to a boat protection and storage device for preventing build-up of bacteria and barnacles and other corrosive materials on a hull of a boat. In its broadest context, the device consists of a housing, a gate member, and a buoyant member. Such components are individually configured and correlated with respect to each other so as to attain the desired objective.

The housing 12 is dimensioned for receiving a boat 14 therein. Note FIG. 6. In the preferred embodiment, the housing 12 is constructed of a molecular polyethylene plastic. The housing 12 is adapted for floating in a body of water. The device 10 can be used in either salt or fresh water environments. The housing 12 has an open upper end, a closed lower end, a closed forward wall, an open rearward wall, and closed opposed side walls. The housing 12 is constructed with reinforced vertically disposed ridges 16. The ridges 16 provide added strength to the housing 12. The housing 12 includes a forward section 18 and a rearward section 20. Note FIGS. 1, 3, and 6. The closed lower end of the forward section 18 has a pair of support webs 22. The rearward section 20 has a greater depth than the forward section for accommodating a motor 24 of a boat 14 positioned within the housing 12. Upper ends of the opposed side walls each have a buoyant portion 32 extending outwardly therefrom. The buoyant portions 32 provide a means for walking along a side of the boat 14. In the preferred embodiment, the opposed side walls have inwardly angled lower ends whereby the closed lower end of the housing 12 is smaller than the open upper end. Note FIG. 3. The buoyant portions are preferably molded plastic sections filled with a foam to increase buoyancy.

The gate member 28 couples with the open rearward wall of the housing 12. The gate member 28 is also constructed with the reinforcement ridges 16. The gate member 28 has a top edge, a bottom edge, and opposed side edges. The bottom edge is hingedly coupled with a lower edge of the open rearward wall. The top edge has a buoyant portion 32 extending outwardly therefrom. The gate member 28 is simply lowered to allow a boat 14 to enter the housing 12 and then is subsequently closed to contain the boat 14 therein.

The buoyant member 32 is secured to the housing 12. The buoyant member 32 is secured to and extend along a length of an upper surface of the lateral edge portions of the opposed side walls.

The buoyancy portion 31 of the gate is not filled with a foam as the other buoyancy portions of the system. The buoyancy portion 31 of the gate has a tube 33 with an upper end 35 on the dock and a lower end 37 at the top of the buoyancy portion. Holes 39 are located along the length of the buoyant member adjacent the bottom while a concrete rod 41 is located within the buoyant portion 32 for weighting purposes. A lock 43 holds the gate in the upper portion. In operation and use, air is blown by a compressor or the like to the upper input end of the tube to blow air into the buoyant device when it is down to allow it to rise to the elevated location for locking in the boat. In order to get the gate to lower, the compressor is used to suck the air from the upper end of the tube out of the buoyant portion to allow water to enter the buoyancy portion for allowing it to lower with the lock disengaged.

The boat 14 is simply driven into the housing 12 and the gate member 28 is shut behind it trapping the domain of water between the boat 14 and the device 10. The water outside the device 10 is exposed to the environment, whereas the water trapped inside the device 10 dies since the bacteria growth is prevented due to lack of food source and water movement. This trapped water becomes purified by the run-off of chemicals used to clean the boat 14 which allows the bottom of the boat toe be cleaned as well. As a result, hull damage is prevented and the necessity of dry docking and scraping/painting is eliminated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A boat protection and storage device for preventing build-up of bacteria and barnacles and other corrosive materials on a hull of a boat comprising, in combination:

a housing dimensioned for receiving a boat therein, the housing being adapted for floating in a body of water, the housing having an open upper end, a closed lower end, a closed forward wall, an open rearward wall, and closed opposed side walls, the housing being constructed with reinforced vertically disposed ridges, the housing including a forward section and a rearward section, the closed lower end of the forward section having a pair of support webs, the rearward section having a greater depth than the forward section for accommodating a motor of a boat positioned within the housing, upper ends of the opposed side walls each having a lateral edge portion extending outwardly therefrom;

a gate member coupling with the open rearward wall of the housing, the gate member having a top edge, a bottom edge, and opposed side edges, the bottom edge being hingedly coupled with a lower edge of the open rearward wall, the top edge having a lateral edge portion extending outwardly therefrom;

a buoyant member secured to the housing, the buoyant member being secured to and extending along a length of an upper surface of the lateral edge portions of the opposed side walls.

2. A boat protection and storage device for preventing building-up of bacteria and barnacles and other corrosive materials on a hull of a boat comprising, in combination:

a housing dimensioned for receiving a boat therein, the housing being adapted for floating in a body of water, the housing having opposed side walls with planar lateral edge portions extending outwardly therefrom allowing one to walk alongside of a boat within the housing;

a gate member, having a top edge with a hollow portion extending outwardly therefrom, a bottom edge, and opposed side edges, the bottom edge hingedly coupling with a lower edge of the open rearward wall of the housing; and a buoyant member secured to the housing.

3. A boat protection and storage device for preventing build-up of bacteria and barnacles and other corrosive materials on a hull of a boat comprising, in combination:

a housing dimensioned for receiving a boat therein, the housing being adapted for floating in a body of water, the housing having opposed side walls having planar lateral edge portions extending outwardly from the upper ends thereof, allowing one to walk alongside of a boat within the housing;

a gate member having an upper edge having a lock and a hollow buoyant member with a tube to add air thereto for flotation purposes coupling with an open rearward wall of the housing; and a buoyant member secured to and extending along a length of an upper surface of the lateral edge portions of the opposed side walls of the housing.

4. A boat protection and storage device for preventing build-up of bacteria and barnacles and other corrosive materials on a hull of a boat comprising, in combination:

a housing dimensioned for receiving a boat therein, the housing being adapted for floating in a body of water, the housing having opposed side walls with planar lateral edge portions extending outwardly therefrom allowing one to walk alongside of a boat within the housing;

a gate member coupling with an open rearward wall of the housing, an upper edge of the gate member having a lock and a hollow buoyant member with a tube to add air thereto for flotation purposes coupling with an open rearward wall of the housing and having a weighting rod within the buoyant member; and a buoyant member secured to the housing.

* * * * *